US010632521B2

(12) United States Patent
Nakashima et al.

(10) Patent No.: US 10,632,521 B2
(45) Date of Patent: Apr. 28, 2020

(54) METHOD FOR PRODUCING A RIFLED TUBE

(71) Applicants: NIPPON STEEL & SUMITOMO METAL CORPORATION, Tokyo (JP); MITSUBISHI HITACHI POWER SYSTEMS, LTD., Kanagawa (JP)

(72) Inventors: Takashi Nakashima, Wakayama (JP); Atsuro Iseda, Tokyo (JP); Takeshi Miki, Wakayama (JP); Shunichi Otsuka, Wakayama (JP)

(73) Assignees: NIPPON STEEL CORPORATION, Tokyo (JP); MITSUBISHI HITACHI POWER SYSTEMS, LTD., Kanagawa (JP)

( * ) Notice: Subject to any disclaimer, the term of this patent is extended or adjusted under 35 U.S.C. 154(b) by 305 days.

(21) Appl. No.: 15/528,774

(22) PCT Filed: Nov. 24, 2015

(86) PCT No.: PCT/JP2015/005823
§ 371 (c)(1),
(2) Date: May 23, 2017

(87) PCT Pub. No.: WO2016/084361
PCT Pub. Date: Jun. 2, 2016

(65) Prior Publication Data

US 2017/0320124 A1 Nov. 9, 2017

(30) Foreign Application Priority Data

Nov. 25, 2014 (JP) ..... 2014-238171

(51) Int. Cl.
*B21C 1/24* (2006.01)
*B21D 53/06* (2006.01)
(Continued)

(52) U.S. Cl.
CPC ..... *B21D 53/06* (2013.01); *B21C 1/24* (2013.01); *B21C 3/16* (2013.01); *B21C 37/20* (2013.01);
(Continued)

(58) Field of Classification Search
CPC ..... B21C 37/20; B21C 37/207
See application file for complete search history.

(56) References Cited

U.S. PATENT DOCUMENTS 3,830,087 A 8/1974 Nakamura et al.
4,799,972 A * 1/1989 Masuyama ..... C22C 38/22 148/325
(Continued)

FOREIGN PATENT DOCUMENTS

WO 2009/081655 7/2009
WO 2009/081670 7/2009

*Primary Examiner* — Debra M Sullivan
(74) *Attorney, Agent, or Firm* — Clark & Brody LP

(57) ABSTRACT

The production method for producing a rifled tube, which includes a plurality of first helical ribs on its inner surface, includes: a steps of:
preparing a steel tube; and producing a rifled tube by performing cold drawing on a steel tube by using a plug which includes a plurality of second helical ribs, the plug satisfying Formulae and:

$$0.08 < W\times(A-B)\times N/(2\pi\times A) < 0.26 \quad (1)$$

$$0.83 < S\times(A-B)\times N/(2\times M) < 2.0 \quad (2)$$

where, W is a width of a groove bottom surface of the helical groove; A is a maximum diameter of the plug; B is a minimum diameter of the plug; N is a number of the second helical ribs; S is the width of the groove bottom surface; and M is a pitch of adjacent second helical ribs.

4 Claims, 8 Drawing Sheets

(51) Int. Cl.

| | |
|---|---|
| ***B21C 3/16*** | (2006.01) |
| ***B21C 37/20*** | (2006.01) |
| ***F28F 1/40*** | (2006.01) |
| ***F28F 21/08*** | (2006.01) |

(52) U.S. Cl.
CPC ..... *B21C 37/207* (2013.01); *F28F 1/40* (2013.01); *F28F 21/082* (2013.01); *F28F 2210/06* (2013.01)

(56) References Cited

U.S. PATENT DOCUMENTS 5,069,870 A * 12/1991 Iseda ..... C22C 38/20 148/325
2005/0229667 A1 10/2005 Jesson et al.

* cited by examiner

METHOD FOR PRODUCING A RIFLED TUBE

TECHNICAL FIELD

The present invention relates to a method for producing a rifled tube having a plurality of helical ribs on its inner surface.

BACKGROUND ART

In a water wall tube of a sub-critical power generation boiler, boiling phenomenon occurs in which water turns into steam. For such a water wall tube, a rifled tube is used. A rifled tube has a plurality of helical ribs on its inner surface. The plurality of ribs increase the surface area of the inner surface, compared to a steel tube without ribs. Therefore, a rifled tube has an increased contact surface between the inner surface and water, thus improving the power generation efficiency of the boiler.

Further, the plurality of ribs agitate water in the tube, and put the water into a turbulent flow state. Therefore, occurrence of film boiling is suppressed. Film boiling is a phenomenon in which a film-like vapor phase is generated on the inner surface of the tube when the water flowing through the tube is heated and transformed into gas vapor at its boiling point. If film boiling occurs, the tube will be overheated to a high temperature beyond the boiling point, and bursting may occur due to overheating. The plurality of ribs suppress occurrence of film boiling, thereby suppressing bursting due to overheating.

For thermal power generation boilers of recent years, improvement of combustion efficiency and improvement (reduction) of $CO_2$ emission are strongly required. To achieve these improvements, temperature and pressure of steam need to be increased. To realize higher temperature and higher pressure of steam, a high-Cr and high strength rifled tube is required.

International Application Publication No. WO2009/081655 (Patent Literature 1) discloses a method for producing a rifled tube. As disclosed in Patent Literature 1, a rifled tube is generally produced by the following method. First, a steel tube is prepared. A plug having a plurality of helical grooves is attached to a nose of a mandrel so as to be rotatable about the axis of the plug. The plug attached to the mandrel is inserted into the steel tube. By using a die, cold drawing is performed on the steel tube into which the plug has been inserted. Through the above described process steps, the rifled tube is produced.

CITATION LIST

Patent Literature

Patent Literature 1: International Application Publication No. WO2009/081655

As described above, a rifled tube has an inner surface of a complicated shape. Therefore, in cold drawing, load exerted on the mandrel may possibly be excessively larger. In such a case, seizure may occur in the plug. Particularly, when producing a rifled tube of high strength, seizure is likely to occur.

SUMMARY OF INVENTION

An objective of the present invention is to provide a method for producing a rifled tube, with which occurrence of seizure due to cold drawing can be suppressed.

A method for producing a rifled tube according to the present invention produces a rifled tube which includes a first helical rib on its inner surface and has an outer diameter of not more than 34 mm. The above described production method includes a step of preparing a steel tube having a tensile strength of not more than 600 MPa, and a step of producing a rifled tube by performing cold drawing on a steel tube by using a plug which includes a plurality of helical grooves and a plurality of second helical ribs each located between adjacent helical grooves, the plug satisfying Formulae (1) and (2):

$$0.08<W\times(A-B)\times N/(2\pi\times A)<0.26 \quad (1)$$

$$0.83<S\times(A-B)\times N/(2\times M)<2.0 \quad (2)$$

where, in Formulae (1) and (2), W is substituted by a width (mm) of a groove bottom surface of the helical groove in a cross section perpendicular to a central axis of the plug; A by a maximum diameter (mm) of the plug; B by a minimum diameter (mm) of the plug in the same cross section as that of the maximum diameter; N by a number of the second helical ribs in the cross-section; S by the width (mm) of the groove bottom surface of the helical groove in a longitudinal section parallel with the central axis of the plug; and M by a pitch (mm) of the second helical rib in the longitudinal section.

The production method according to the present invention can suppress occurrence of seizure due to cold drawing.

DESCRIPTION OF EMBODIMENTS

Figure 1:
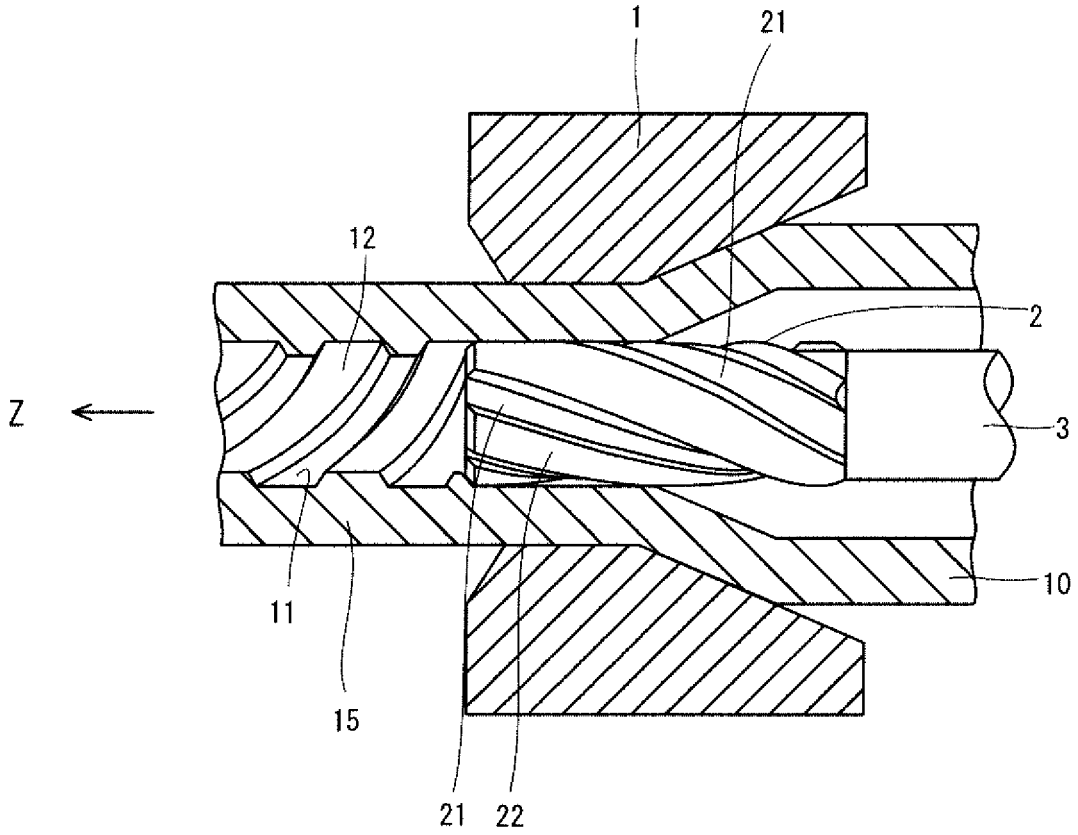
FIG. 1 is a schematic diagram of a cold drawing step in the method for producing a rifled tube according to the present embodiment.

A method for producing a rifled tube according to the present invention produces a rifled tube which has a first helical rib on its inner surface and has an outer diameter of not more than 34 mm. The above described production method includes a step of preparing a steel tube having a tensile strength of not more than 600 MPa, and produces a rifled tube by performing cold drawing on a steel tube by using a plug which includes a plurality of helical grooves and a plurality of second helical ribs each located between adjacent helical grooves, the plug satisfying Formulae (1) and (2):

$$0.08<W\times(A-B)\times N/(2\pi\times A)<0.26 \quad (1)$$

$$0.83<S\times(A-B)\times N/(2\times M)<2.0 \quad (2)$$

where, in Formulae (1) and (2), W is substituted by a width (mm) of a groove bottom surface of the helical groove in a cross section perpendicular to a central axis of the plug; A by a maximum diameter (mm) of the plug; B by a minimum diameter (mm) in the same cross section as that of the maximum diameter of the plug; N by a number of second helical ribs in the cross-section; S by the width (mm) of the groove bottom surface of the helical groove in a longitudinal section parallel with the central axis of the plug; and M by a pitch (mm) of the second helical rib in the longitudinal section.

In the method for producing a rifled tube according to the present embodiment, a rifled tube is produced by using a plug which satisfies Formulae (1) and (2) described above. In this case, it is possible to suppress occurrence of seizure in the plug in the cold drawing step.

In the above described step of producing a rifled tube, for example, a rifled tube in which a lead angle of the first helical rib is 20 to 43 deg is produced.

In the above described step of preparing a steel tube, a steel tube having a tensile strength of not more than 500 MPa may be prepared, and in the step of producing a rifled tube, a rifled tube in which the lead angle is 30 to 43 deg may be produced.

When the tensile strength of the steel tube is not more than 500 MPa, even if a rifled tube of a large lead angle such as 30 to 43 deg is produced, a lead angle of high accuracy can be obtained.

In the step of preparing a steel tube, a steel tube having a chemical composition containing not more than 9.5% of Cr in mass % may be prepared.

In the step of preparing a steel tube, a two-stage heat treatment step may be performed on a blank tube containing not more than 2.6% of Cr in mass % to prepare a steel tube having a tensile strength of not more than 500 MPa. The two-stage heat treatment step includes a step of soaking a blank tube at a first heat treatment temperature of $Ac_3$ point to $Ac_3$ point+50° C., and a step of reducing the heat treatment temperature to a second heat treatment temperature of less than $Ar_1$ point to $Ar_1$ point−100° C. after soaking at a first heat treatment temperature, and soaking the blank tube at the second heat treatment temperature.

In this case, a steel tube whose Cr content is not more than 2.6% may have a tensile strength of not more than 500 MPa.

Hereinafter, referring to the drawings, embodiments of the present invention will be described in detail. Like or corresponding parts in the figures are given like reference symbols, and description thereof will not be repeated.

[Production Method of Rifled Tube]

The method for producing a rifled tube according to the present embodiment includes a step of preparing a steel tube (preparation step), and a step of performing cold drawing (cold drawing step). Hereinafter, the preparation step and cold drawing step will be described in detail.

[Preparation Step]

First, a steel tube for a rifled tube is prepared.

The tensile strength of the steel tube is not more than 600 MPa. When the tensile strength of the steel tube is too high, the workability will be deteriorated. For that reason, cold drawing will become difficult, and seizure will occur in the plug. When the tensile strength of the steel tube is not more than 600 MPa, seizure is unlikely to occur. Accordingly, an upper limit of the tensile strength of the steel tube is 600 MPa, preferably 500 MPa, and further preferably 480 MPa. A lower limit of the tensile strength of the steel tube is preferably 400 MPa.

As long as the above described tensile strength is achieved, the chemical composition of the steel tube will not be particularly limited. Preferably, the steel tube contains not more than 9.5% of Cr in mass %. Chromium (Cr) increases high-temperature strength of steel. Further, Cr improves corrosion resistance and oxidation resistance at high temperatures. However, when the Cr content is too high, it becomes difficult to suppress the tensile strength to be not more than 600 MPa. Accordingly, an upper limit of the Cr content is preferably 9.5%. The upper limit of the Cr content is more preferably 6.0%, further preferably 2.6%, and most preferably 2.3%. A lower limit of the Cr content is preferably 0.5%.

The steel tube may be a seamless steel tube or may be a welded steel tube typified by an electric resistance welded steel tube. The method for producing a steel tube is not particularly limited. A seamless steel tube may be produced by the Mannesmann-mandrel process, and an electric resistance welded steel tube may be produced by an electric resistance welding method and the like.

[Cold Drawing Step]

The prepared steel tube is subjected to a cold drawing step.

FIG. 1 is a schematic diagram of a cold drawing step of the present embodiment. Referring to FIG. 1, a cold drawing apparatus includes a die 1, a plug 2, and a mandrel 3.

The die 1 includes, in the order from an entrance side (right side in FIG. 1) toward an exit side (left side in FIG. 1), an approach part, a bearing part, and a relief part, successively. The approach part has a so-called taper shape in which the inner diameter gradually decreases from the entrance side toward the exit side of the die 1. However, the shape of the approach part is not limited to the tapered type, and other shapes such as an R-type having a curvature will not be precluded. The bearing part is made up of a cylinder, whose inner diameter is constant and corresponds to the die diameter. In the relief part, the inner diameter gradually increases from the entrance side toward the exit side. The die 1 is fixed, for example, to a draw bench not shown.

The plug 2 has a columnar shape. The plug 2 includes a plurality of helical grooves 21 and a plurality of second helical ribs 22 on its surface. The second helical rib 22 is located between adjacent helical grooves 21. The plurality of helical grooves 21 and the second helical ribs 22 extend in a helical fashion along the central axis of the plug 2. The plurality of helical grooves 21 and the second helical ribs 22 form a plurality of first helical ribs 12 on the inner surface 11 of the rifled tube 15. The first helical rib 12 extends in a helical fashion along the central axis of the rifled tube 15. As a result of formation of the plurality of first helical ribs 12, the inner surface 11 constitutes helical grooves. The first helical rib 12 and the helical groove (inner surface) 11 are alternately arranged.

A front end of the plug 2 is attached to a rear end of the mandrel 3. At this time, the plug 2 is attached to the mandrel 3 so as to be rotatable around the central axis of the plug 2. In the cold drawing step, the plug 2 forms first helical ribs 12 on the inner surface of the steel tube 10 while the plug 2 rotates. The mandrel 3 supports the plug 2 during cold drawing, and holds the plug 2 in a predetermined position.

[Formula (1) and Formula (2)]

The plug 2 further satisfies Formulae (1) and (2):

$$0.08<W\times(A-B)\times N/(2\pi\times A)<0.26 \quad (1)$$

$$0.83<S\times(A-B)\times N/(2\times M)<2.0 \quad (2)$$

where, in Formulae (1) and (2), W is substituted by a width (mm) of a groove bottom surface of the helical groove 21 in a cross section perpendicular to a central axis of the plug 2. A is substituted by a maximum diameter (mm) of the plug 2, and B is substituted by a minimum diameter (mm) of the plug 2 in the same cross section as that of the maximum diameter A. N is substituted by a number of the second helical ribs 22 in the above described cross section. S is substituted by the width (mm) of the groove bottom surface of the helical groove 21 in a longitudinal section parallel with the central axis of the plug 2. M is substituted by a pitch (mm) of adjacent second helical ribs 22 in the above described longitudinal section. Hereinafter, Formulae (1) and (2) will be described in detail.

[Formula (1)]

Figure 2:
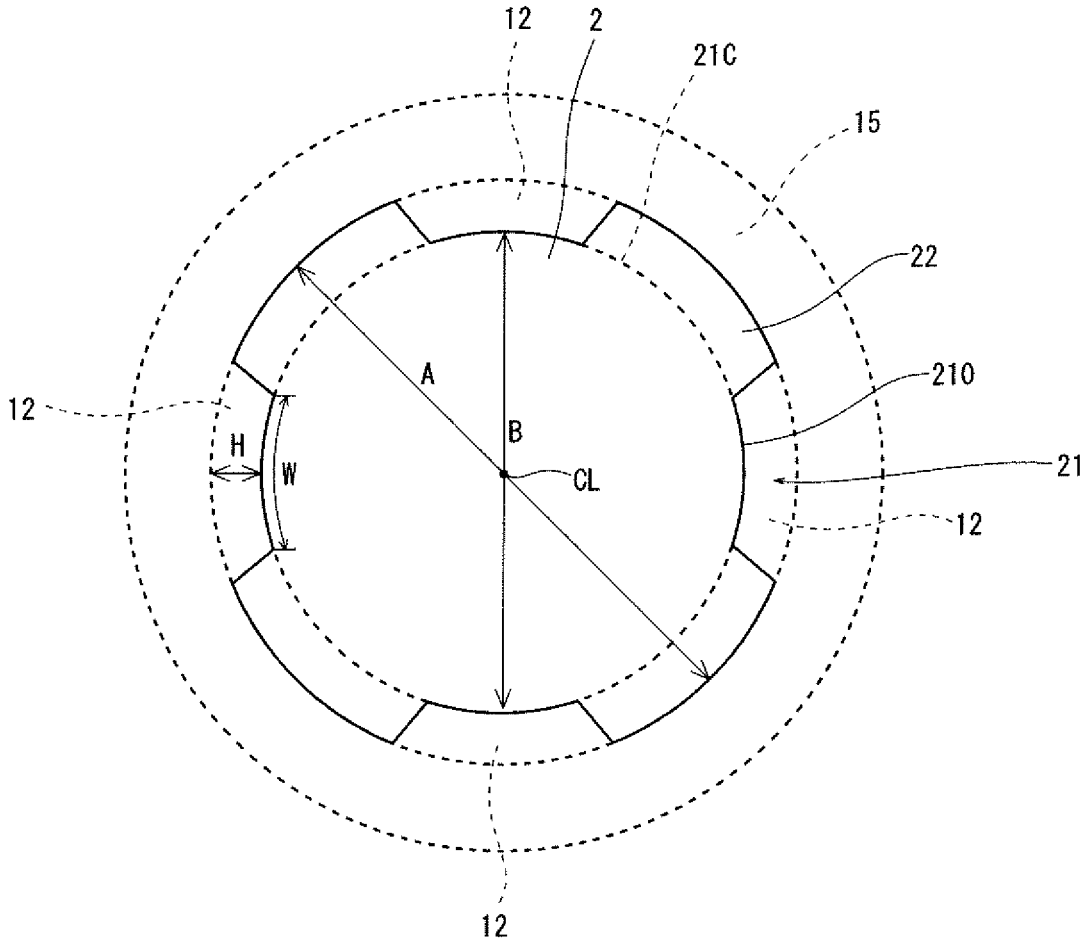
FIG. 2 is a cross-sectional view perpendicular to a central axis of a plug in FIG. 1.

Formula (1) shows the relationship between the second helical rib 22 and helical groove 21 in a cross section of the plug 2. FIG. 2 is a sectional (cross-sectional) view perpendicular to the central axis of the plug 2 in FIG. 1. A maximum circle indicated by a broken line in FIG. 2 is an outer peripheral surface of a rifle tube 15.

As described above, the plug 2 includes the helical groove 21 and the second helical rib 22. In a portion corresponding to the helical groove 21, the first helical rib 12 of the rifle tube 15 is formed.

Figure 3:
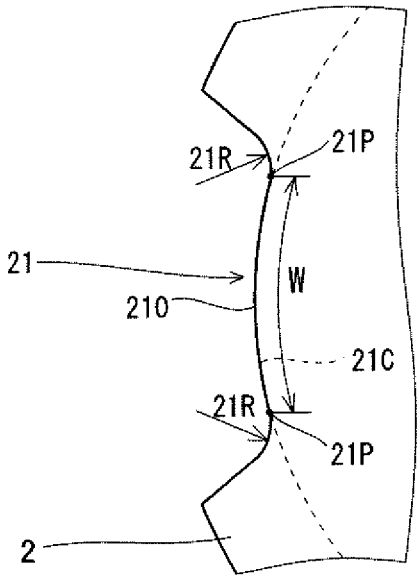
FIG. 3 is a partially enlarged view of a cross section of another plug having a shape different from that of FIG. 2.

Referring to FIG. 2, W is the width (mm) of the groove bottom surface 210 of the helical groove 21 in a cross section. The width W is represented by the distance (mm) along a circle 21C of a minimum diameter B of the plug 2 in the cross section. As shown in FIG. 3, if the edge portion of the groove bottom surface 210 is curved with a radius of curvature 21R, the width W is defined by the distance (mm) between two intersection points 21P at which the edge part of the radius of curvature 21R intersects with the circle 21C.

Referring to FIG. 2, a maximum diameter A (mm) is a straight line distance from the top of a second helical rib 22 up to the top of the second helical rib 22 on the opposite side through the central axis CL of the plug 2. A minimum diameter B (mm) is a straight line distance from the groove bottom surface 210 of a helical groove 21 up to the groove bottom surface 210 on the opposite side through the central axis CL in the same cross section as that of the maximum diameter A. N is the number of the helical ribs 22 in the cross-section shown in FIG. 2. In FIG. 2, N is 4. However, the number of the second helical ribs 22 is not particularly limited as long as it is plural. The number N of the second helical ribs 22 may be 2 or may be 6. The number of the second helical ribs 22 may be an odd number.

A load exerted on the plug 2 during cold drawing is dependent on the degree of unevenness in the outer peripheral surface of the plug 2, that is, dependent on the shapes of the helical groove 21 and the second helical rib 22.

It is defined such that $F1=W\times(A-B)\times N/(2\pi\times A)$. F1 indicates a proportion occupied by the helical groove 21 in the outer peripheral surface of the plug 2. When F1 is not less than 0.26, the load exerted on the plug 2 becomes excessively high and seizure is likely to occur in the plug 2. When F1 is less than 0.26, it is possible to suppress the load exerted on the plug 2 on condition that Formula (2) is satisfied. Therefore, in the cold drawing, seizure is unlikely to occur in the plug 2. An upper limit of F1 is preferably 0.22, and more preferably 0.18.

On the other hand, when F1 is not more than 0.08, the cross sectional area of the first helical rib 12 becomes too small, and it will not function as a rifled tube. Therefore, F1 is greater than 0.08. A lower limit of F1 is preferably 0.10, and more preferably 0.12.

[Formula (2)]

Figure 4:
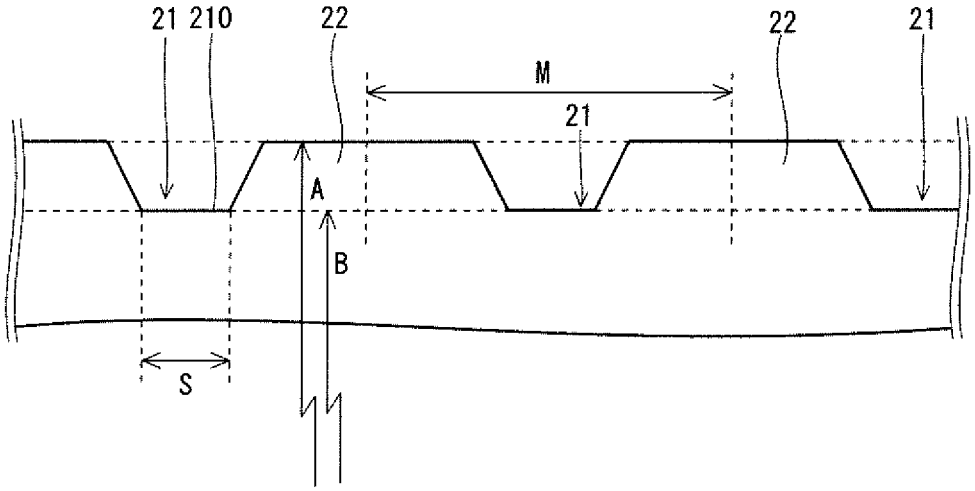
FIG. 4 is a partially enlarged view of a longitudinal section parallel with the central axis of the plug in FIG. 1.

Formula (2) shows the relationship between the second helical rib 22 and helical groove 21 in a longitudinal section of the plug 2. FIG. 4 shows a part of a section parallel with the central axis (longitudinal section) of the plug 2 in FIG. 1.

Referring to FIG. 4, a width S of the helical groove 21 in a longitudinal section is represented by a distance (a straight-line distance in this case, in the unit of mm) along the outer peripheral surface (a straight line in this case) of a minimum diameter B of the plug 2. M is a pitch (mm) of the second helical rib 22, and specifically is the distance between adjacent second helical ribs 22 in a longitudinal section. As shown in FIG. 4, the distance between the center of a second helical rib 22 and the center of an adjacent second helical rib 22 is defined as a pitch (mm). When an edge of the groove bottom of the helical groove 21 in the longitudinal section has a radius of curvature, the width S is determined in the same manner as the width W is.

A load exerted on the plug 2 during cold drawing is, as described above, dependent on the degree of unevenness of the outer peripheral surface of the plug 2. Not only the cross sectional shape of the plug 2, but also the longitudinal sectional shape affects the degree of unevenness of the outer peripheral surface of the plug 2.

It is defined such that $F2=S\times(A-B)\times N/(2\times M)$. F2 indicates a proportion occupied by the helical groove 21 in the outer peripheral surface of the plug 2. When F2 is not less than 2.0, the load exerted on the plug 2 becomes excessively high, and seizure is likely to occur in the plug 2. When F2 is less than 2.0, it is possible to suppress the load exerted on the plug 2 on condition that Formula (1) is satisfied. As a result of that, seizure is unlikely to occur in the plug 2 in cold drawing. An upper limit of F2 is preferably 1.8.

On the other hand, when F2 is not more than 0.83, the rifle tube 15 will not function as a rifle tube since the area of the longitudinal sectional shape of the first helical rib 12 of the rifle tube 15 is too small. Accordingly, a lower limit of F2 is more than 0.83. The lower limit of F2 is more preferably 0.90.

[Cold Drawing]

The cold drawing step using a plug 2 of the above described shape is performed, for example, as follows. First, a front end part of the steel tube 10 is subjected to nosing. Next, the front end part of the processed steel tube 10 is inserted into the die 1. After insertion, the steel tube 10 is fixed. For example, the front end part of the steel tube 10 is gripped by a chuck of a drawbench (not shown). Thus, the steel tube 10 is fixed.

Next, the plug 2 is rotatably attached to the nose of the mandrel 3. After attachment, the plug 2 is inserted into the steel tube 10 from the rear end side of the steel tube 10 (entrance side of the die 1) in the drawing direction Z (see FIG. 1).

Subsequently, the steel tube 10, which is fixed by the chuck or the like, is drawn in the drawing direction Z. At this moment, the plug 2 is advanced in the drawing direction Z so that the plug 2 is held at a position where the portion having the maximum diameter A of the plug 2 is closer to the exit side than to the approach part of the die 1. After the plug 2 is held, the steel tube 10 is further drawn to produce a rifled tube 15. During the cold drawing, as the steel tube 10 is drawn in the drawing direction Z, the plug 2 is driven to move (automatically rotate) in association therewith. As a result of automatic rotation of the plug 2, a plurality of first helical ribs 12 are formed in the inner surface 11 of the steel tube 10.

Note that before cold drawing, a chemical treatment is performed on the inner and outer surfaces of the steel tube to be subjected to cold drawing, and the cold drawing is carried out.

The production method described above is particularly suitable for the preparation of a rifled tube 15 having an outer diameter of not more than 34 mm. When the outer diameter of the rifled tube 15 to be produced is large, the diameter of the plug 2 to be used also becomes large. When the diameter of the plug 2 is large, the area ratio of the helical groove 21 with respect to the diameter of the plug 2 naturally becomes small. In this case, the uneven shape of the outer peripheral surface of the plug 2 when subjected to the cold drawing does not significantly have an effect on seizure of the plug 2. In contrast to this, when the outside diameter of the rifled tube 15 is small, the diameter of the plug 2 becomes also small. In this case, the area ratio of the helical groove 21 with respect to the diameter of the plug 2 increases, and the shapes of the helical groove 21 and the second helical rib 22 have an effect on seizure of the plug 2 during cold drawing. According to the production method of the present embodiment, it is possible to suppress occurrence of seizure even when a rifled tube 15 having an outer diameter of not more than 34 mm is produced.

Figure 5:
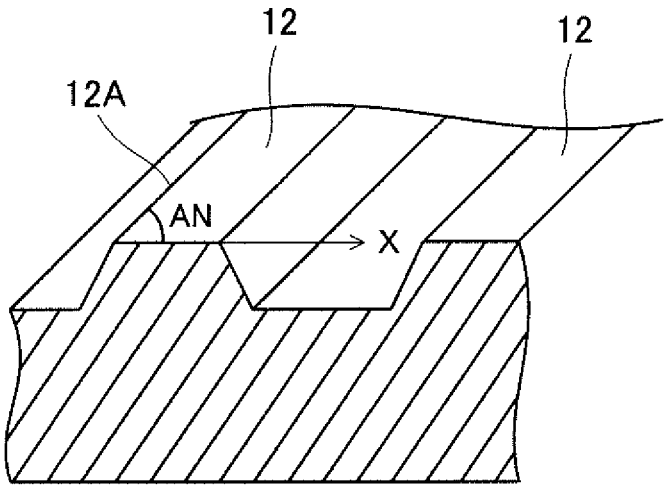
FIG. 5 is a longitudinal sectional perspective view of the proximity of the inner surface of the rifled tube.

According to the production method described above, it is possible to suppress occurrence of seizure of the plug 2 in cold drawing even if the lead angle of the first helical rib 12 of the rifled tube 15 is 20 to 43 deg. In this specification, as shown in FIG. 5, the lead angle (deg) is defined as an angle AN formed between the tube axis direction X of the rifled tube 15 and a side edge 12A of the upper surface of the first helical rib 12. The lead angle is preferably 30 to 43 deg. In this case, the rifled tube 15 can further suppress occurrence of film boiling.

[Softening Heat Treatment Step]

Preferably, the above described preparation step includes a softening heat treatment step. In the softening heat treatment step, before the cold drawing step is carried out, the blank tube is softened by heat treatment to form a steel tube. This will improve workability of the steel tube in the cold drawing step.

In the softening heat treatment step, for example, a one-stage heat treatment is performed. The one-stage heat treatment is as follows. The blank tube is charged into a heat treatment furnace. The blank tube is soaked at a heat treatment temperature from less than $Ac_1$ point to $Ac_1$ point−100° C. The soaking time is preferably 30 to 60 minutes. As a result of the heat treatment step described above, it becomes easy to thermally refine the steel tube so as to have a tensile strength of not more than 600 MPa.

More preferably, a two-stage heat treatment, in place of the one-stage heat treatment, is performed. The two-stage beat treatment includes a first heat treatment step and a second heat treatment step. In the first heat treatment step, first, the blank tube is charged into a heat treatment furnace and is soaked at a first heat treatment temperature, which is a γ range temperature of $Ac_3$ point to $Ac_3$ point+50° C. (the first heat treatment step). Subsequently, the heat treatment temperature is lowered to a second heat treatment temperature of less than $Ar_1$ point to $Ar_1$ point−100° C., and the blank tube is soaked at the second heat treatment temperature (the second heat treatment step). In this heat treatment method, in the first heat treatment step, the microstructure of the blank tube becomes an austenite single phase. And, isothermal transformation occurs in the second heat treatment step. In this case, compared with the one-stage heat treatment, the tensile strength of the steel tube after heat treatment is further reduced. The soaking time in the first heat treatment step is preferably 5 minutes to 10 minutes. The soaking time in the second heat treatment step is preferably 30 minutes to 60 minutes. The first heat treatment step and the second heat treatment step may be performed in the same heat treatment furnace, or may be performed in different heat treatment furnaces.

When increasing the lead angle of the first helical rib 12 for a steel tube of high strength, specifically, when increasing the lead angle of the helical rib 12 to be 30 to 43 deg by using a steel tube containing not more than 2.25% of Cr in mass %, it is possible to improve the accuracy of the lead angle of the rib 12 by performing the two-stage heat treatment. Specifically, by performing the two-stage heat treatment, it is made possible to suppress the error between the lead angle after production and the set value (target value) of the lead angle to be not more than 3 deg.

[Other Steps]

In the production method described above, before carrying out the cold drawing step using the plug 2, cold drawing for forming the steel tube having a circular cross section may be performed by using a plug having a smooth surface for the purpose of increasing the roundness of the steel tube.

Furthermore, before performing the cold drawing for forming the steel tube having a circular cross section, a lubricating treatment such as a chemical treatment is performed on the inner and outer surfaces of the steel tube. Oxide scale of the inner and outer surfaces of the steel tube may be removed by a descaling treatment after the heat treatment step and before carrying out the cold drawing step. In this case, the chemical treatment is performed after the descaling treatment.

[Shape of Plug 2]

Figure 6:
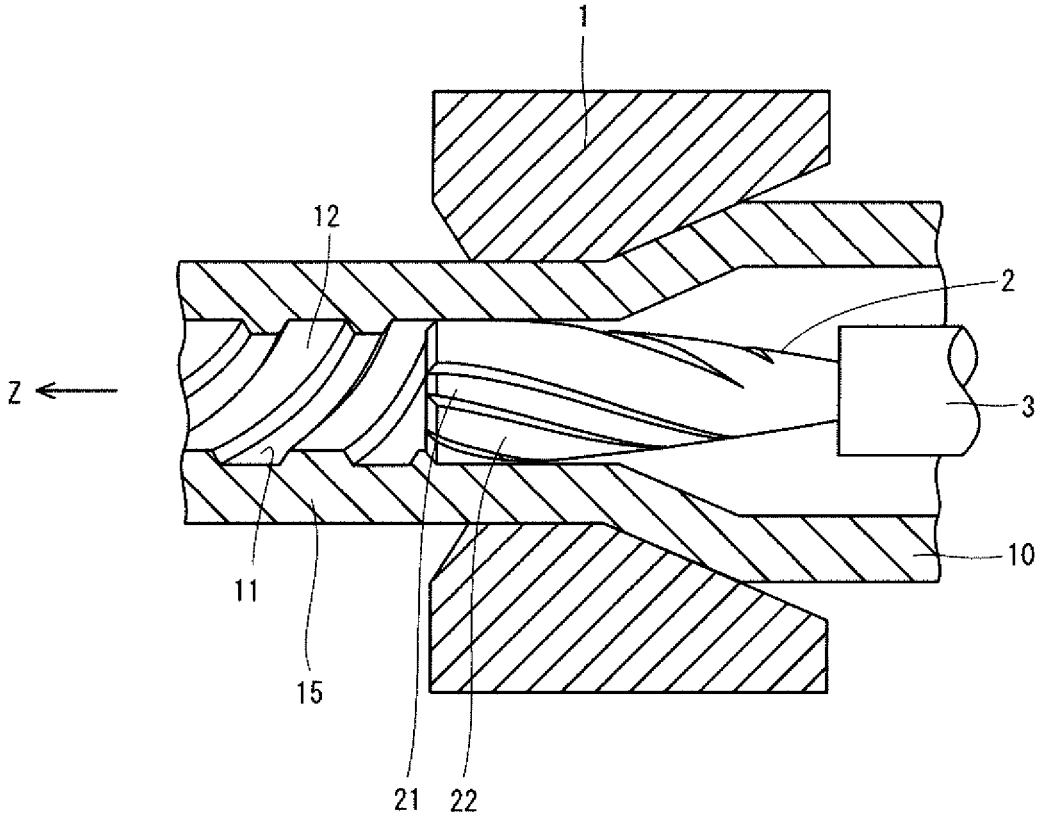
FIG. 6 is a schematic view of a cold drawing step using another plug having a shape different from those of FIGS. 1 and 3.

In the embodiment described above, the plug 2 has a columnar shape. However, the shape of the plug 2 is not limited to a column. For example, the plug 2 may be bullet-shaped as shown in FIG. 6.

Figure 7:
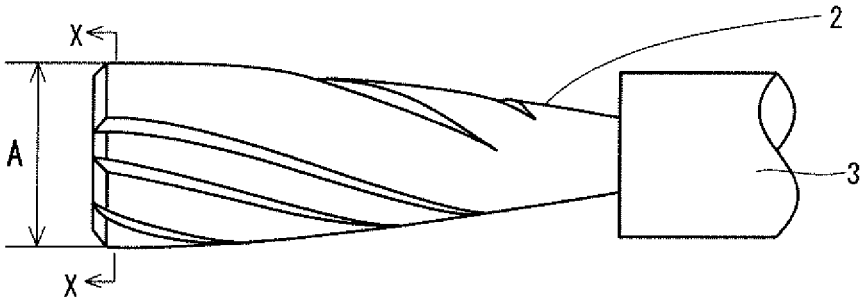
FIG. 7 is a side view of the plug in FIG. 6.

When the plug 2 is bullet-shaped, the area of the cross section of the plug 2 increases as proceeding to the rear end in the central axis CL direction of the plug 2. Therefore, in the plug 2 of bullet shape, the maximum diameter A is positioned at the rear end of the plug 2. As shown in FIG. 7, when the maximum diameter A is obtained in cross-section X, the minimum diameter B is supposed to be the minimum diameter in the cross section X where the maximum diameter A is obtained.

Even if the plug 2 is bullet-shaped, it is also possible to achieve the effects described above when Formulae (1) and (2) are satisfied.

EXAMPLES

Example 1

A plurality of rifled tubes having ribs of different shapes were produced to investigate occurrence or nonoccurrence of seizure in cold drawing.

[Test Method]

Steel tubes were subjected to cold drawing using a columnar plug shown in FIG. 1 to produce rifled tubes.

TABLE 1

| Test | Plug Shape | | Steel Tube Tensile Strength | Rifled Tube Shape Outer Diameter | Thickness | Maximum Load | | |
|---|---|---|---|---|---|---|---|---|
| No. | F1 | F2 | (MPa) | (mm) | (mm) | (ton) | Evaluation | Remarks |
| 1 | 0.22 | 1.29 | 481 | 31.8 | 6.0 | 3.0 | NF | Present Invention |
| 2 | 0.16 | 0.94 | 478 | 31.8 | 6.4 | 2.9 | NF | Present Invention |
| 3 | 0.21 | 1.71 | 465 | 31.8 | 6.0 | 3.0 | NF | Present Invention |
| 4 | 0.32 | 1.29 | 462 | 28.6 | 5.7 | 3.8 | F | Comparative Example |
| 5 | 0.27 | 1.07 | 486 | 31.8 | 5.6 | 3.7 | F | Comparative Example |
| 6 | 0.29 | 1.73 | 479 | 45.0 | 6.1 | 5.8 | F | Comparative Example |
| 7 | 0.38 | 3.84 | 477 | 57.1 | 6.0 | 8.7 | F | Comparative Example |
| 8 | 0.39 | 3.15 | 497 | 60.3 | 13.0 | 15.7 | F | Comparative Example |
| 9 | 0.30 | 2.28 | 483 | 63.5 | 6.1 | 9.0 | F | Comparative Example |
| 10 | 0.25 | 2.00 | 471 | 31.8 | 6.0 | 3.5 | F | Comparative Example |

Plugs used in Test Nos. 1 to 10 each had a shape different from each other. F1 and F2 of each plug were as shown in Table 1.

Each steel tube of each test number, which was prepared by cold drawing, had a chemical composition corresponding to STBA22 defined in JIS G3462 (2009) and contained 1.25 mass % of Cr. The $Ac_1$ point of these steel tubes was 742° C. Each steel tube was produced by the following method. A billet having the chemical composition described above was prepared. By using the billet, a blank tube was produced by the Mannesmann-mandrel process. In order to improve the roundness, cold drawing process was performed on the blank tube by using a plug having smooth surface to produce a steel tube (seamless steel tube).

The one-stage heat treatment described above was performed on each steel tube. For each steel tube, the heat treatment temperature was 740° C. and the soaking time was 20 minutes.

Tensile test specimens were taken from steel tubes after heat treatment, and were subjected to a tensile test at room temperature (25° C.) to obtain tensile strengths TS (MPa). The resultant tensile strengths TS were 462 MPa to 497 MPa.

The steel tubes after heat treatment were subjected to cold drawing by use of zinc phosphate based lubricant and plugs having F1 and F2 shown in Table 1 to produce rifled tubes. The outer diameters (mm) and thicknesses (mm) of the rifled tubes were as shown in Table 1.

After the cold drawing, the surface of each plug used was visually observed to confirm the occurrence or nonoccurrence of seizure. In addition, maximum loads exerted on the mandrel during cold drawing were measured.

[Test Results]

The test results are shown in Table 1. "NF" (Not Found) in "Evaluation" column in Table 1 means that no seizure was observed. "F" (Found) means that seizure was observed.

Figure 8:
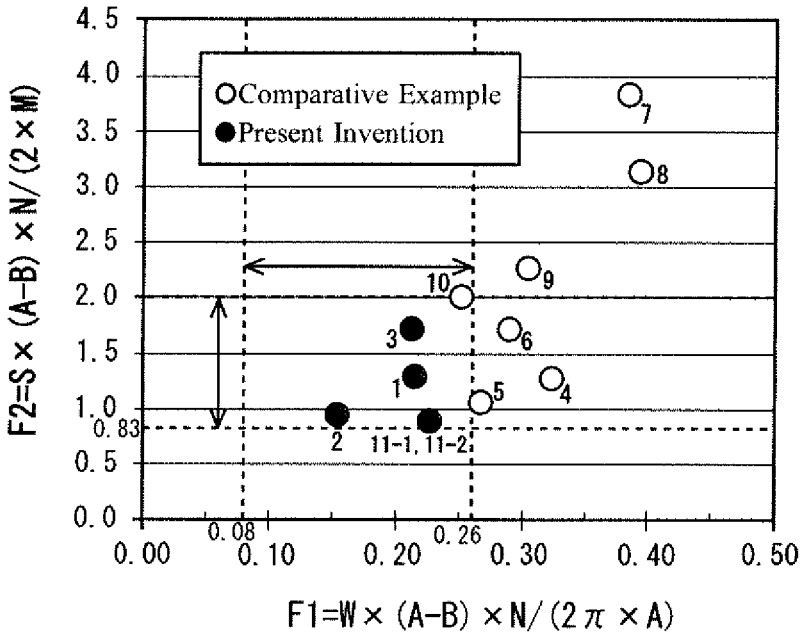
FIG. 8 is a diagram showing the relationship between F1 and F2, and seizure in Examples.

Further, FIG. 8 is a diagram showing relationship between F1 and F2, and occurrence or nonoccurrence of seizure. An open circle (○) in FIG. 8 means that no seizure occurred, and a solid circle (●) means that seizure occurred. The numbers denoted next to the open circle and the solid circle refer to Test Nos.

Referring to Table 1 and FIG. 8, in Test Nos. 1 to 3, F1 and F2 of the plug used satisfied Formulae (1) and (2). Therefore, even when rifled tubes having an outer diameter of as small as not more than 34 mm were produced, the maximum loads during cold drawing were less than 3.5 ton, and no seizing was observed.

In Test Nos. 4 to 6, although F2 of the plugs used satisfied Formula (2), F1 did not satisfy Formula (1). Therefore, maximum loads during cold drawing became not less than 3.5 ton, and seizure was observed.

In Test Nos. 7 to 9, F1 of plugs used did not satisfy Formula (1), and F2 did not satisfy Formula (2). Therefore, maximum loads during cold drawing became not less than 3.5 ton, and seizure was observed.

In Test No. 10, although F1 of the plugs used satisfied Formula (1), F2 did not satisfy Formula (2). Therefore, the maximum load became not less than 3.5 ton when producing rifled tubes having an outer diameter of not more than 34 mm, and seizure was observed.

Example 2

Accuracy of the lead angle was investigated in connection to the difference in softening heat treatment step.

[Test Method]

A plurality of steel tubes having a chemical composition corresponding to STBA24 defined in JIS G3462 (2009) and containing 2.25 mass % of Cr were prepared. The $Ar_1$ point of these steel tubes was 773° C. and the $Ac_3$ point was 881° C.

These steel tubes were produced by the following method. Using a billet having the above described chemical composition, blank tubes were produced by the Mannesmann-mandrel process. In order to increase the roundness, blank tubes were subjected to cold drawing using a plug having smooth surface. After the steps described above, steel tubes (seamless steel tubes) of each Test No. were prepared.

A two-stage heat treatment was performed on Test No. 11-1 and a one-stage heat treatment was performed on Test No. 11-2.

Specifically, the steel tube of Test No. 11-1 was subjected to a two-stage heat treatment in which the heat treatment temperature in the first heat treatment step was 920° C., and the soaking time was 10 minutes. The heat treatment temperature in the second heat treatment step was 725° C., and the soaking time was 45 minutes.

On the other hand, the steel tube of Test No. 11-2 was subjected to a one-step heat treatment, in which the heat treatment temperature was 760° C., and the soaking time was 20 minutes.

A tensile test specimen was taken from each steel tube after heat treatment. Using the tensile test specimen, a tensile test was performed at room temperature (25° C.) to obtain a tensile strength TS (MPa). The resulting tensile strengths TS were 460 MPa for Test No. 11, and 530 MPa for Test No. 12.

Subsequently, the steel tubes of Test Nos. 11-1 and 11-2 were subjected to cold drawing by using the plugs of F1 and F2 shown in Table 2 to produce rifled tubes. At this time, the helical groove of the plug was set such that the lead angle of the rifled tube would be 40 deg. In the same manner as in Example 1, the load exerted on the mandrel during cold drawing was measured to obtain the maximum load thereof.

The outer diameter of the rifled tube of each Test No. produced was 31.8 mm, and the thickness thereof was 5.6 mm.

After cold drawing, the surface of the plug used was visually observed to confirm the occurrence or nonoccurrence of seizure. Furthermore, the lead angle of each rifled tube produced was measured. Then, an error of the measured lead angle from 40 deg was calculated. When the error was −0 to +3 deg, it was evaluated as that the lead angle was highly accurate.

[Test Results]

Test results are shown in Table 2. The "lead angle evaluation" column shows the results of measurement of lead angle. In the "lead angle evaluation" column, "E" (Excellent) means that the error was −0 deg to +3 deg. "G" (Good) means that the error was −0 deg to −1 deg (excluding −0 deg), or more than +3 deg to +5 deg.

TABLE 2

| Test | Heat Treatment | | Plug Shape | | Steel Tube Tensile Strength | Rifled Tube Shape Outer Diameter | Thickness | Maximum Load | Seizure | Lead Angle |
|---|---|---|---|---|---|---|---|---|---|---|
| No. | Type | Temperature | F1 | F2 | (MPa) | (mm) | (mm) | (ton) | Evaluation | Evaluation |
| 11-1 | Two-stage Heat Treatment | First Stage: 920° C. Second Stage: 725° C. | 0.23 | 0.90 | 460 | 31.8 | 5.6 | 2.7 | NF | E |
| 11-2 | One-stage Heat Treatment | 760° C. | 0.23 | 0.90 | 530 | 31.8 | 5.6 | 3.1 | NF | G |

Referring to Table 2, in each of the rifled tubes of Test Nos. 11-1 and 11-2, the rib shape of the plug satisfied Formulae (1) and (2). Therefore, no seizure was observed in the plug after cold drawing.

Further, in the steel tube of Test No. 11-1, as a result of performing the two-stage heat treatment, the tensile strength TS before cold drawing was lower than that of Test No. 11-2 as was not more than 500 MPa. Therefore, Test No. 11-1, compared with Test No. 11-2, had a lower maximum load, and the accuracy of the lead angle was as high as within −0 to +3 deg.

So far embodiments of the present invention have been described. However, the above described embodiments are merely examples for carrying out the present invention. Accordingly, the present invention is not limited to the embodiments described above, but can be carried out by appropriately altering the embodiments described above within a range not departing from the spirit thereof.

The invention claimed is:

1. A production method for producing a rifled tube for a thermal power generation boiler, comprising:

a step of preparing a steel tube having a chemical composition containing not more than 2.6% of Cr in mass % and having a tensile strength of not more than 600 MPa, and a step of performing a chemical treatment and a cold drawing on the steel tube by using a plug to produce the rifled tube including a plurality of first helical ribs on the inner surface of the rifled tube and having an outer diameter of not more than 34 mm, wherein the plug includes:

a plurality of helical grooves; and a plurality of second helical ribs each located between adjacent helical grooves; wherein in a cross section perpendicular to a central axis of the plug, the plug has a maximum diameter A (mm) and a minimum diameter B (mm), in the cross section, the plug has N second helical ribs, in the cross section, a groove bottom surface of the helical groove of the plug has a width W (mm), in a longitudinal section parallel with the central axis of the plug, the groove bottom surface of the helical groove of the plug has a width S (mm), and in the longitudinal section, adjacent second helical ribs are arranged by a pitch M (mm), wherein, the maximum diameter A, the minimum diameter B, a number of the second helical groove N, and the width W satisfy Formula (1), and the maximum diameter A, the minimum diameter B, a number of the second helical groove N, the width W and the pitch M satisfy Formula (2), $$0.08<W\times(A-B)\times N/(2\pi\times A)<0.26 \quad (1)$$

$$0.83<S\times(A-B)\times N/(2\times M)<2.0 \quad (2).$$

2. The production method according to claim 1, wherein in the step of producing the rifled tube, the rifled tube in which a lead angle of the first helical rib is 20 to 43 deg is produced.

3. The production method according to claim 2, wherein in the step of preparing the steel tube, the steel tube having a tensile strength of not more than 500 MPa is prepared, and in the step of producing the rifled tube, the rifled tube in which the lead angle is 30 to 43 deg is produced.

4. The production method according to claim 3, wherein in the step of preparing the steel tube, a two-stage heat treatment step is performed on a blank tube to produce the steel tube having a tensile strength of not more than 500 MPa, and wherein the two-stage heat treatment step comprises:

a step of soaking the blank tube at a first heat treatment temperature of $Ac_3$ point to $Ac_3$ point +50° C., and a step of reducing the first heat treatment temperature to a second heat treatment temperature of less than $Ar_1$ point to $Ar_1$ point−100° C. after the soaking, and soaking the blank tube at the second heat treatment temperature.

* * * * *